US006789627B2

(12) United States Patent
Leismer

(10) Patent No.: US 6,789,627 B2
(45) Date of Patent: Sep. 14, 2004

(54) CONTROL LINE CUTTING TOOL AND METHOD

(75) Inventor: Dwayne D. Leismer, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 90 days.

(21) Appl. No.: 09/839,187

(22) Filed: Apr. 19, 2001

(65) Prior Publication Data

US 2001/0045283 A1 Nov. 29, 2001

Related U.S. Application Data

(60) Provisional application No. 60/204,239, filed on May 15, 2000.

(51) Int. Cl.[7] ..... E21B 17/06

(52) U.S. Cl. ..... 166/377; 166/54.5; 166/66.4; 166/117; 166/242.6

(58) Field of Search ..... 166/376, 377, 166/54.5, 298, 55.2, 65.1, 61.4, 117, 242.6, 54.6; 285/1–3; 83/694, 950

(56) References Cited

U.S. PATENT DOCUMENTS

| | | | | |
|---|---|---|---|---|
| 3,193,013 A | * | 7/1965 | Whiteside | 166/54.5 |
| 3,731,742 A | * | 5/1973 | Sizer et al. | 166/375 |
| 3,926,252 A | | 12/1975 | Ribeyre et al. | |
| 4,160,478 A | | 7/1979 | Calhoun et al. | |
| 4,427,059 A | | 1/1984 | Olivier | |
| 4,512,411 A | | 4/1985 | Pringle | |
| 4,653,776 A | | 3/1987 | Borg | |
| 4,660,635 A | | 4/1987 | Wittrisch | |
| 4,706,744 A | | 11/1987 | Smith et al. | 166/65 |
| 4,738,312 A | | 4/1988 | Wittrisch | |
| 4,753,291 A | | 6/1988 | Smith et al. | 166/65.1 |
| 4,759,406 A | | 7/1988 | Smith et al. | 166/65.1 |
| 4,981,177 A | | 1/1991 | Carmody et al. | |
| 4,997,041 A | * | 3/1991 | Petree | 166/377 |
| 5,201,814 A | | 4/1993 | Kitchell et al. | 166/65.1 |
| 5,257,663 A | | 11/1993 | Pringle et al. | |
| 5,323,853 A | * | 6/1994 | Leismer et al. | 166/55 |
| 5,720,348 A | | 2/1998 | Hisaw | |
| 6,397,948 B1 | * | 6/2002 | Williams et al. | 166/363 |

FOREIGN PATENT DOCUMENTS

| | | | |
|---|---|---|---|
| WO | WO 00/65194 | 11/2000 | E21B/29/04 |

* cited by examiner

*Primary Examiner*—Zakiya Walker
(74) *Attorney, Agent, or Firm*—Williams, Morgan & Amerson, P.C.; Jeffrey E. Griffin; Brigitte Jeffery Echols

(57) ABSTRACT

An apparatus includes a first member, a second member releasably attached to the first member, and a control line shear mechanism disposed proximate an interface between the first member and the second member. The first and second members can each have a longitudinal bore therethrough and can be moveable in an axial direction to release from one another. The control line shear mechanism may comprise a first shear member attached to the first number and a second shear member attached to the second member, wherein the first and second shear members are adapted to cooperatively shear a control line as the first and second members separate. A method includes separating a first member from a second member and, before or during the separating step, cutting a control line proximal to the paint of separation of the first and second members.

20 Claims, 5 Drawing Sheets

CONTROL LINE CUTTING TOOL AND METHOD

The present application claims the benefit of U.S. provisional application No. 60/204,239 filed on May 15, 2000.

BACKGROUND OF THE INVENTION

1. Field of the Invention

This invention relates generally to tools used to complete subterranean wells. More specifically, the invention relates to a device and method for severing or cutting a control line at a remote location.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids.

To improve the efficiency of hydrocarbon recovery, wells have begun to incorporate more sophisticated equipment. Examples of such equipment, sometimes referred to as intelligent well or smart well equipment, include monitoring devices, such as gauges, control systems, flow control devices, and other devices designed to recover hydrocarbons more intelligently. Typically, these devices communicate with one another and with the surface or to command equipment in the well via control lines. The control lines may be electrical, hydraulic, fiber optic, or any other type of telemetry communication line. They can be used for the conveyance of fluids for hydraulic actuation or for chemical injection. They may also contain electric wires for power or data transmission.

Often there is a need to separate a section of tubing from a piece of lower equipment in a well to facilitate the removal of the tubing and completion equipment. For example, the tubing may need to be separated from a sand screen completion and pulled from the well. Such a separation is typically done using a safety sub, but other means of separating are well known to those skilled in the art. A safety sub is designed to provide a known separation point within the tubing string, or its attachments, upon the occurrence of a predetermined event, such as the imposition of a force upon the safety sub.

In wells containing control lines, the control lines are generally run into the well in conjunction with the tubing string. If the tubing string is separated and removed from the well and the control line is not also severed in a controlled manner, the act of pulling the tubing from the well will likely cause the control line to stretch and break at some undetermined location. Although such a break may occur at or near the separation point of the tubing from the other downhole equipment, the control line break will likely occur at some point spaced from the tubing separation point. If the break is not at the tubing separation point, there will remain a length of loose control line in the well. If the loose control line is on the equipment or connected to the portion pulled from the well, the control line may catch on other downhole equipment as it passes through the well and damage such equipment or impede the removal of the tubing string. If the loose control line is left on the equipment that is left in the well, the control line may catch and impede equipment in the well or equipment placed in the well at a later time. The control line can become tangled within the wellbore above the remaining equipment in the well. Retrieving the tangled mass of control line can lead to a time consuming and costly recovery effort, often called a "fishing job", to remove the unwanted control line and regain access to the equipment that is left in the well.

Thus, despite the use of the prior art features, there remains a need for a device to accurately cut the control line proximal the point of tubing separation.

SUMMARY OF THE INVENTION

To achieve such improvements, the present invention provides mechanisms and methods for parting a control line.

One embodiment of the present invention is an apparatus comprising a first member, a second member releasably attached to the first member, and a control line shear mechanism. The first and second members can each have a longitudinal bore therethrough and can be moveable in an axial direction to release from one another. The control line shear mechanism may comprise a first shear member attached to the first member and a second shear member attached to the second member, where the first and second shear members are adapted to cooperatively shear a control line as the first and second members separate. The control line shear mechanism may either be integral to the first and second member or may be attached to the first and second members. The first and second members may be releasably attached to each other by a release mechanism, such as a shear element. One form of the control line shear mechanism can comprise a control line passageway within the first and second members. This control line passageway may comprise a recess on the external surface of the first and second members.

Another embodiment of the invention is an apparatus comprising a first tubular member and a second tubular member releasably attached to the first tubular member where the first and second tubular members are moveable in an axial direction to release from one another. The apparatus further comprises a control line shear mechanism comprising a first and second control line shear member where the first control line shear member is attached to the first tubular member, the second control line shear member is attached to the second tubular member and the first and second control line shear members are adapted to cooperatively shear a control line as the first and second tubular members separate.

In still another embodiment a shear sub comprises a first member and a second member releasably attached to the first member. The first and second members define a control line passageway and the control line passageway comprises a pair of shearing blades that are adapted to shear a control line during release. The control line passageway can be positioned at an angle to the direction of release and can comprise a recess on the external surface of the first and second members. The control line passageway may also comprise a passageway enclosed within the first and second members.

Yet another embodiment of the invention is a method that comprises separating a first member from a second member and before or during the separating step, cutting a control line proximal to the point of separation of the first and second members. The first and second members may comprise a safety joint that is used to connect two segments of a tubular string within a wellbore. The safety joint may comprise a control line cutting mechanism that cuts the control line as the first and second members are separated, but the separation of the first member from the second member can be independent from the cutting of the control line.

In an alternative embodiment of the invention a method of completing a well includes providing a tubular string comprising a safety sub where the safety sub comprises a control line cutting mechanism. A control line is attached to the tubular string, the control line being disposed through the control line cutting mechanism, and the tubular string and control line are inserted into the well. The method can further comprise separating the tubular string at the safety sub and cutting the control line with the control line cutting mechanism and can also include the removal of the upper portion of the separated tubular string and the upper portion of the sheared control line from the well.

BRIEF DESCRIPTION OF THE DRAWINGS

The manner in which these objectives and other desirable characteristics can be obtained is explained in the following description and attached drawings in which.

Figure 1:
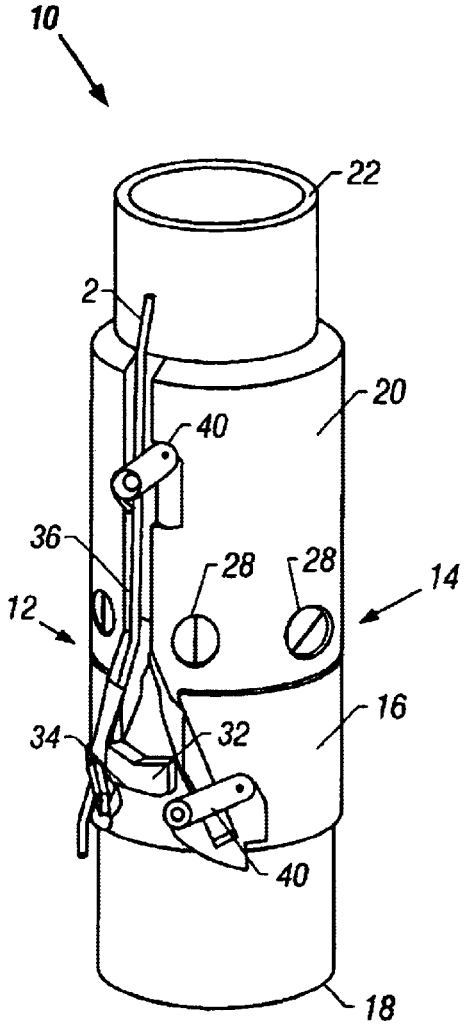
FIG. 1 is an isometric view of an embodiment of the present invention.
Figure 2:
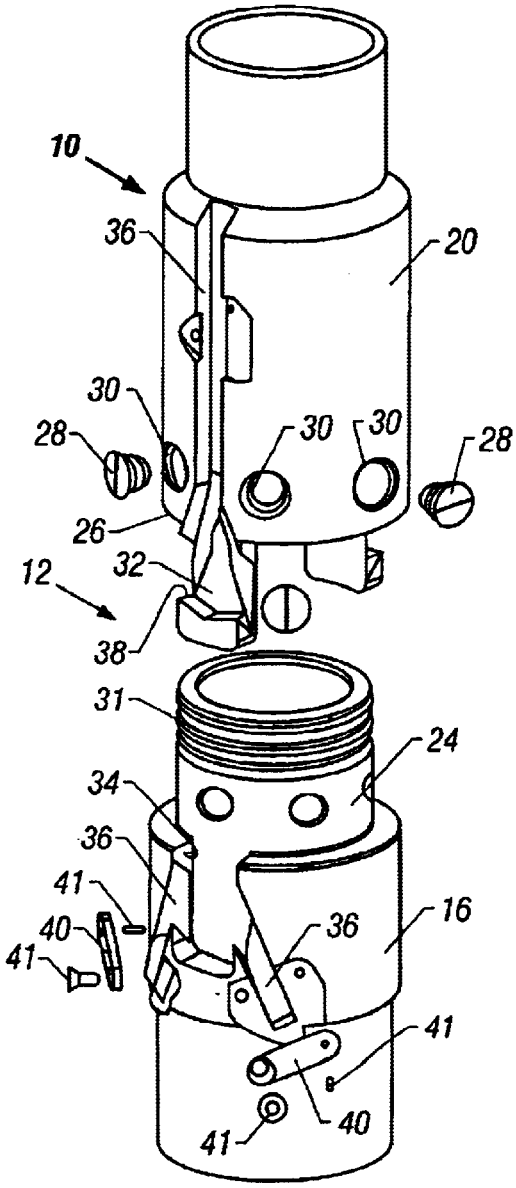
FIG. 2 is an exploded isometric view of the embodiment shown in FIG. 1.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The embodiments of the present invention shown in FIGS. 1 through 4 generally provide a safety sub 10 that includes a mechanism 12 for cutting a control line 2 upon separation of the safety sub 10.

As used herein the term "control line" shall mean any type of control line used in a well including, inter alia, electrical, hydraulic, or fiber optic control lines or other communication, power, telemetry, or control lines used in wells. Often, such lines are shielded by encapsulating them in tubing or other form of conduit. The invention is useful in water wells and other types of wells as well as hydrocarbon wells.

FIGS. 1 through 4 disclose one possible embodiment of the present invention in the form of a shear sub 10. As is generally known to one skilled in the art, a shear sub is used to connect a pair of tubulars (or other components such as downhole tools) and may also be referred to as a safety sub, a safety joint, or other terms generally known to those skilled in the art. The shear sub 10, in general, includes a release mechanism 14 that permits selective separation of the tubulars. Thus, interconnected tubulars or devices positioned in a well may be separated at a selected time by performing a predetermined release step or actuating a predetermined release mechanism. Such mechanisms may include a wide variety of methods and devices. For clarity and ease of description the present application explains only one mechanical type release. It should be noted that other types of releases, such as electrical, chemical, hydraulic, and other mechanical releases are known and can be utilized with the present invention.

The embodiments shown in FIGS. 1 through 4 is a safety sub 10 comprising a first member 16, or upper connector, that has an upper end 18 adapted for connection to a downhole tubular or tool such as a production tubing. The connection may be by conventional threads or other conventional devices. The safety sub also includes a second member 20, or lower connector, that has a lower end 22 adapted for connection to a downhole tubular or device, such as a sand face completion string including a sand screen. The connection may be by conventional devices.

The first member 16 has a lower, male end 24 that fits into a mating upper, female end 26 of the second member. With the male portion 24 of the first member 16 positioned within the female portion 26 of the second member 20, shear pins 28 are placed radially through aligned shear pin holes 30. The shear pins 28 hold the first member 16 and the second member 20 together until a sufficient longitudinal force is applied to at least one of the first or second members to shear or break the shear pins 28 and, thereby, release the first member 16 and second member 20 from one another. The shear pins 28 are designed to shear by applying tension to the tubing, but will also allow limited torque transmission across the safety sub 10. Preferably, the safety sub 10 uses a plurality of shear pins 28 for the releasable support. Note that, as previously mentioned, other mechanisms may be used to provide the selective release. Examples of such devices include hydraulically actuated mechanisms that use a j-slot mechanism, electrical mechanisms using a solenoid, or a mechanical separator based upon relative rotation of the parts. The male portion 24 of the first member 16 includes a set of seal grooves 31 for receiving seals, such as O-rings, metal compression rings or other types of sealing elements.

Figure 3:
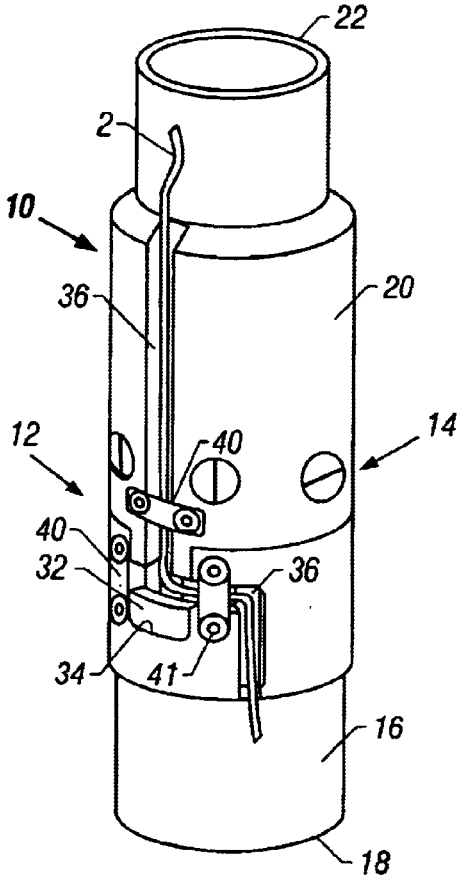
FIG. 3 is an isometric view of an alternative embodiment of the present invention.
Figure 4:
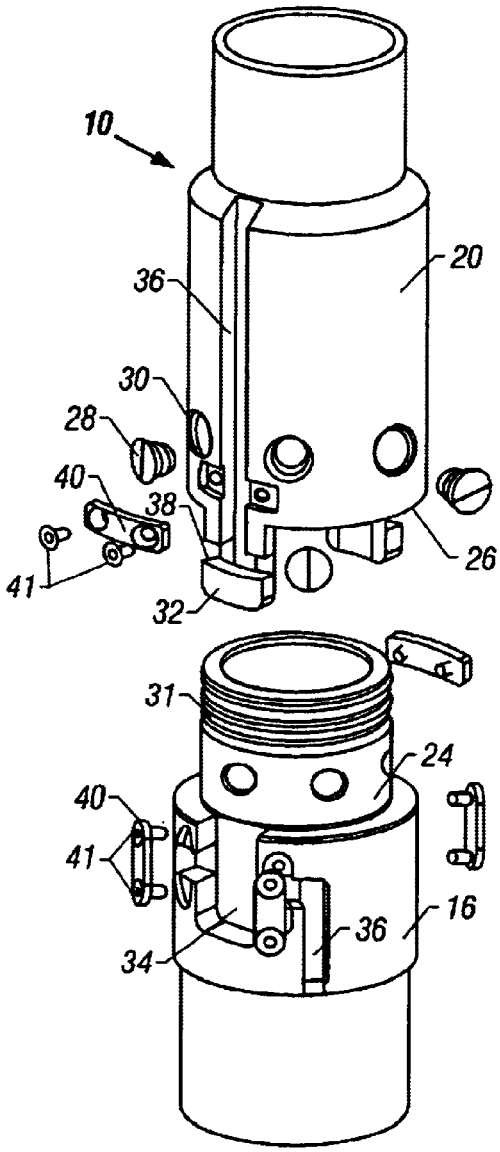
FIG. 4 is an exploded isometric view of the embodiment shown in FIG. 3.

The second member 20 includes at least one finger 32 extending in an axial direction that fits within a complementary axial slot 34 in the first member 16. The first and second members define a control line passageway 36 that, when the safety sub 10 is assembled, provides a passageway through which a control line 2 may be run. The passageway 36 is at an angle to the axial direction so that the finger 32 creates a cutting blade relative to the first member 16. The side surface of the finger 32 and the side surface of the slot 34 are in very close proximity and are preferably in sliding abutment. The passageway 36 extends to the side of the finger 32 and the side of the slot 34. Therefore, when the first member 16 and second member 20 move relative to one another, the finger 32 and slot 34 act as cutting blades to shear the control line 2. The thickness and strength of the control line 2 may determine the required tolerance for the finger 32 and slot 34 as well as other factors such as the angle of the passageway 36 and the shear point and the sharpness of the blade surface 38 and the materials used. As a representative example, FIG. 1 shows a passageway that runs at about a 20° angle to the axial direction. The embodiment of FIG. 3 shows a passageway that runs at a 90° angle to the axial direction (circumferentially). Depending upon the application, the angle may change to virtually any angle greater than zero, but preferably an angle of at least 5° would be used. Lower angles may be used if the tool is longer. The end of the finger 32 may be shaped to form an actual blade with an angled cutting edge 38 as shown best in FIGS. 2 and 4. Note that the cutting edges 38 may be treated with metallurgy or coatings to harden or otherwise improve the cutting effectiveness of the device. The safety sub 10 may define a plurality of such passageways and cutting devices.

Figure 5:
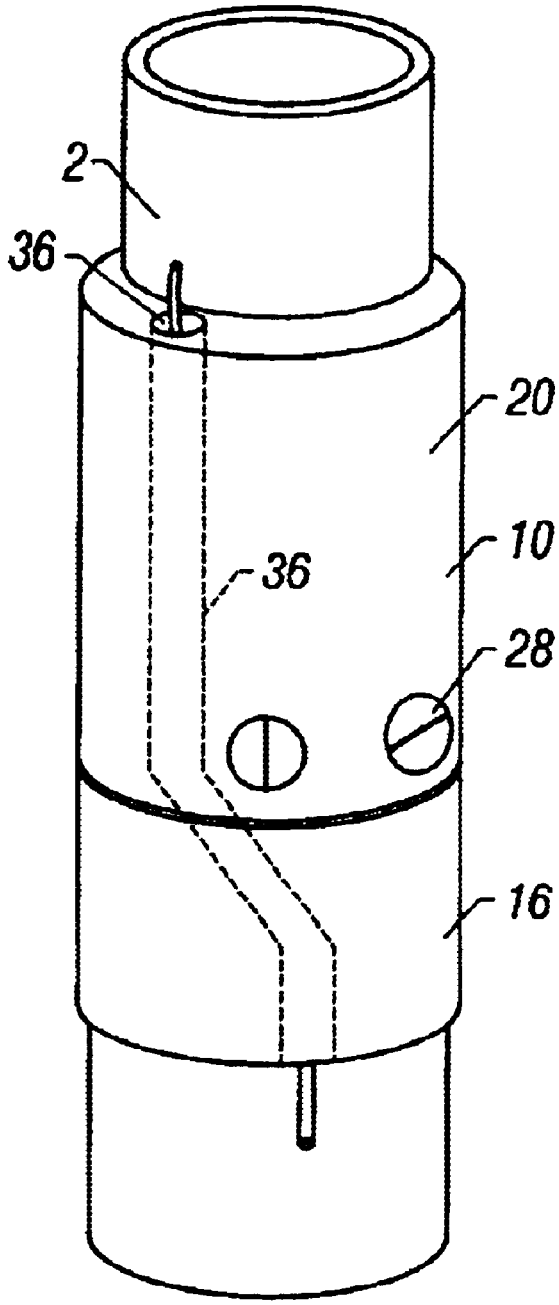
FIG. 5 is an isometric view of an alternative embodiment of the present invention.

Brackets 40 may be used to hold the control line 2 within the control line passageway 36. The brackets 40 can be made such that they are connected to the safety sub 10 by pins 41 that can be screwed, welded or press fitted such that they will not inadvertently separate from the safety sub 10. Other methods may be used to attach the brackets 40 to the safety sub 10 and are known to those skilled in the art. It is preferable that the brackets 40 maintain the attachment of the parted control line 2 to the separated members (16, 20) of the safety sub 10. If the brackets 40 maintain attachment of the control line 2 to the safety sub 10, this will help prevent the sections of parted control line 2 from becoming tangled within the wellbore and restricting removal of the separated tubular string from the well or restricting access to the equipment left in the well. Although the previous embodiments show an external passageway, the passageway 36 could be internal as well as shown in FIG. 5. Alternate embodiments can have the passageway 36 enclosed within the wall of the safety sub 10, as a recess on the interior wall of the safety sub 10 or located within the interior of the safety sub 10. If the passageway is located within the longitudinal bore of the safety sub 10, it can comprise a separate conduit element (not shown) to protect the contents of the passageway from activity occurring within the longitudinal bore of the safety sub 10.

Figure 6:
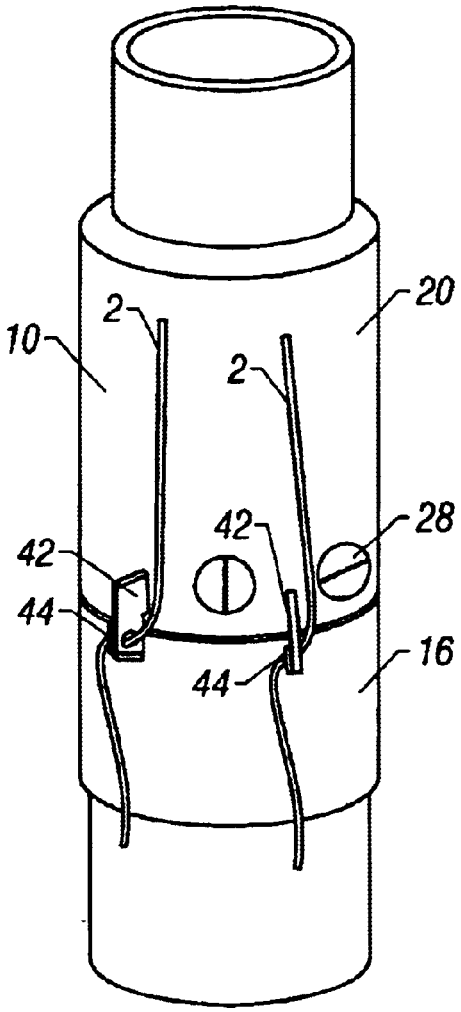
FIG. 6 is an isometric view of an alternative embodiment of the present invention.
Figure 7:
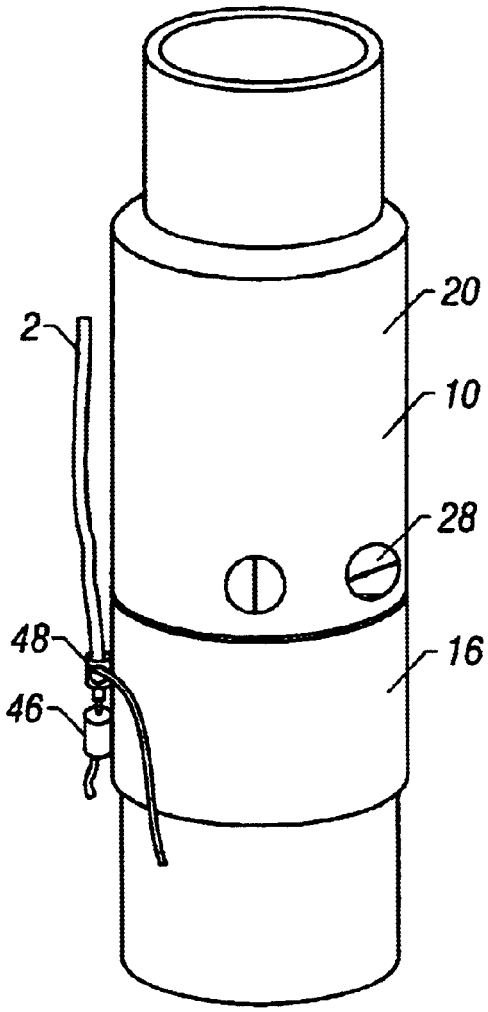
FIG. 7 is an isometric view of an alternative embodiment of the present invention.

Likewise, although the previous embodiments show an extensive passageway, the cutting mechanism could simply be a pair of blades (42, 44) through which the control line 2 is run as shown in FIG. 6. The blades (42, 44) act to cut the control line 2 as the first member 16 and second member 20 separate from one another. Further, the cutting device could be independent of the motion of the first and second members (16, 20). For example, as shown in FIG. 7, the cutting device can comprise a solenoid 46 driven cutter 48 that cuts the control line 2 regardless of the motion of the other safety sub components. The solenoid could be replaced by a hydraulic cylinder or some other drive mechanism. Some embodiments of the invention are independent of the means by which the tubing is parted, and therefore can be used if means, other than those described herein, are used to part the tubing.

Figure 8:
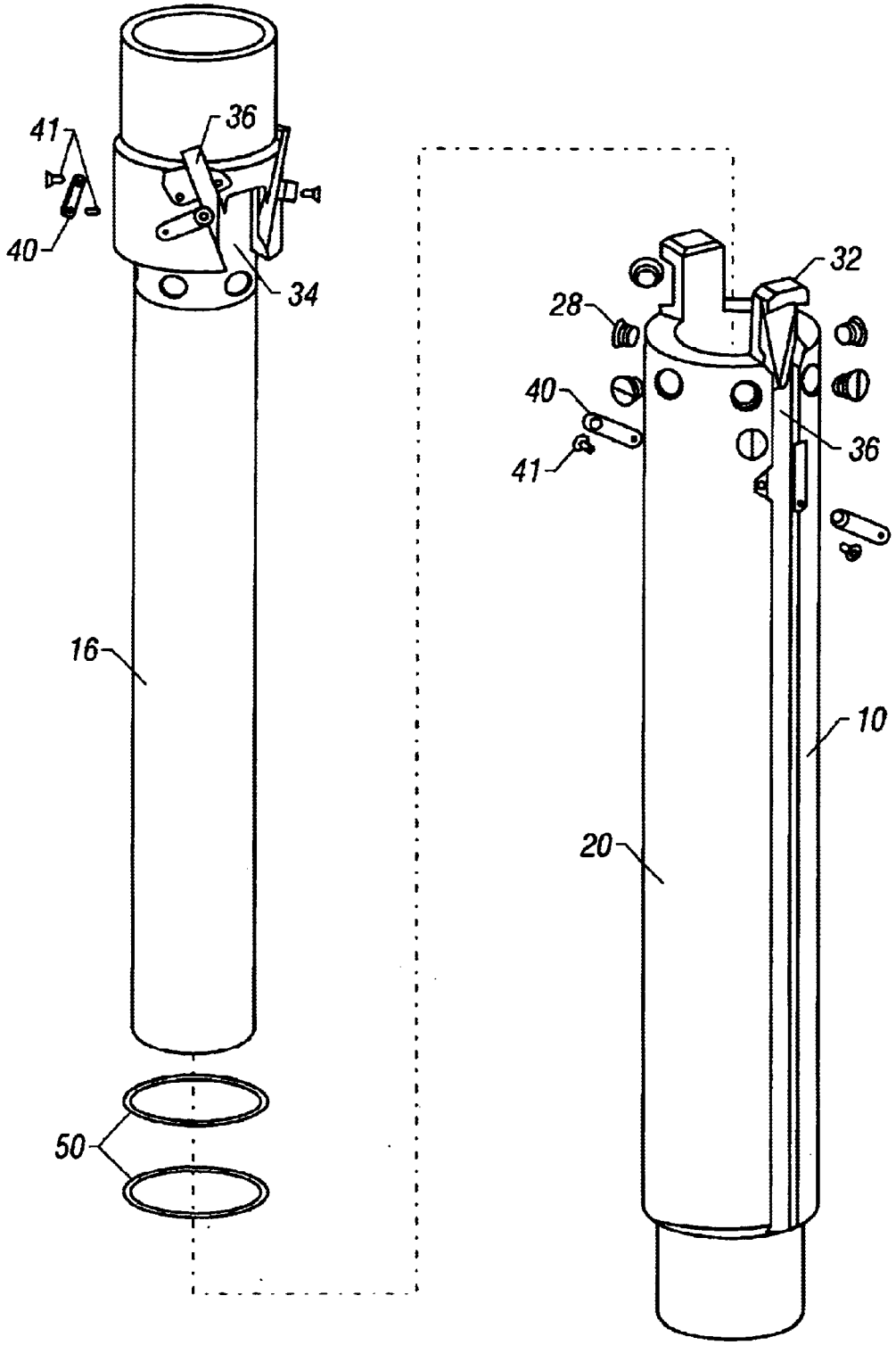
FIG. 8 is an exploded isometric view of an alternative embodiment of the present invention.

In the embodiment shown in FIG. 8, the second member 20, which is the upper component, is extended longitudinally so as to allow a grapple to grasp it for retrieval. Note that the device may incorporate other features to facilitate retrieval, such as internal or external profiles or other known retrieval mechanisms. There are many fishing or retrieval methods that can be used to attach to and pull the remaining equipment from the well that are known to those skilled in the art. FIG. 8 shows the O-rings 50 previously discussed. Other methods besides O-rings can be used to establish a seal between the first and second members (16, 20). The sealing method selected is often dictated by the environment of the application and can comprise sealing elements made from materials such as elastomers, plastics, metal to metal, or others known to those skilled in the art.

Note that although the previous embodiments generally show the cutting device as an integral part of the safety sub 10, in an alternative embodiment the cutting device is a separate component that is attached to the safety sub or to a tubular string by some other method, such as by bolting or welding. In this way the control line cutting device may be attached to a standard tubing string at or near a position where it is anticipated a break will be made, such as by a chemical, burning, mechanical, hydraulic or explosive means. The use of such an attachable control line cutter will allow its use in all tubing cutting situations. One or more control line cutters can be spaced along a well string to facilitate the severing of the control line at a future time, even if the need for control line cutting is not necessarily anticipated.

The discussion and illustrations within this application refer to a vertical wellbore. The present invention can also be utilized in wellbores that have an orientation that is deviated from vertical.

While the foregoing is directed to the preferred embodiment of the present invention, other and further embodiments of the invention may be devised without departing from the basic scope thereof, and the scope thereof is determined by the claims that follow. It is the express intention of the applicant not to invoke 35 U.S.C. §112, paragraph 6 for any limitations of any of the claims herein, except for those in which the claim expressly uses the word "means" together with an associated function.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus, comprising:

a first member;

a second member releasably attached to the first member; and a control line shear mechanism disposed proximate an interface between the first member and the second member, wherein:

the first and second members are moveable in an axial direction to release from one another;

the control line shear mechanism comprises a first shear member attached to the first member and a second shear member attached to the second member; and the first and second shear members are adapted to cooperatively shear a control line as the first and second members separate.

2. The apparatus of claim 1, wherein the first and second members are releasably attached to each other by a release mechanism.

3. The apparatus of claim 2, wherein the release mechanism comprises a shear element.

4. The apparatus of claim 2, wherein the control line shear mechanism comprises a control line passageway within the first and second members.

5. The apparatus of claim 4, wherein the control line passageway comprises a recess on the external surface of the first and second members.

6. An apparatus, comprising:

a first member;

a second member releasably attached to the first member; and a control line shear mechanism disposed proximate an interface between the first member and the second member, wherein the control line shear mechanism is integral to the first and second member; and wherein the first and second members are adapted for releasably connecting devices in a well.

7. An apparatus, comprising:

a first member;

a second member releasably attached to the first member; and a control line shear mechanism disposed proximate an interface between the first member and the second member, wherein the control line shear mechanism comprises a solenoid driven cutter.

8. An apparatus, comprising:

a first tubular member;

a second tubular member releasably attached to the first tubular member;

the first and second tubular members are moveable in an axial direction to release from one another;

a control line shear mechanism, disposed proximate an interface between the first member and the second member, comprising a first and second control line shear member;

the first control line shear member being attached to the first tubular member;

the second control line shear member being attached to the second tubular member; and the first and second control line shear members are adapted to cooperatively shear a control line as the first and second tubular members separate.

9. A shear sub, comprising:

a first member;

a second member releasably attached to the first member;

the first and second members defining a control line passageway; and the control line passageway comprising a pair of shearing blades adapted to shear a control line during release.

10. The shear sub of claim 9, wherein the control line passageway is positioned at an angle to the direction of release.

11. The shear sub of claim 10, wherein the control line passageway comprises a recess on the external surface of the first and second members.

12. The shear sub of claim 10, wherein the control line passageway comprises a passageway enclosed within the first and second members.

13. A method, comprising:

releasing a first member from a second member, such that devices within a well are released from one another; and before or during the releasing step, cutting a control line proximal to the point of separation of the first and second members.

14. The method of claim 13, wherein the first and second members comprise a safety joint.

15. The method of claim 14, wherein the safety joint is used to connect two segments of a tubular string within a wellbore.

16. The method of claim 15, wherein the safety joint comprises a control line cutting mechanism that cuts the control line as the first and second members are separated.

17. The method of claim 13, wherein the separation of the first member from the second member is independent from the cutting of the control line.

18. A method, comprising:

releasing a first member from a second member; and before or during the releasing step, cutting a control line proximal to the point of separation of the first and second members, wherein the separation of the first member from the second member is independent from the cutting of the control line and the cutting of the control line is achieved using a solenoid driven cutter.

19. A method of completing a well comprising:

providing a tubular string comprising a safety sub, the safety sub including a point of separation and comprising a control line cutting mechanism;

attaching a control line to the tubular string, the control line being disposed through the control line cutting mechanism;

inserting the tubular string and control line into the well;

separating the tubular string at the safety sub; and cutting the control line with the control line cutting mechanism at the point of separation.

20. The method of claim 19, further comprising:

removing the upper portion of the separated tubular string and the upper portion of the cut control line from the well.

* * * * *